US012460501B2

(12) United States Patent
Al Shaikh et al.

(10) Patent No.: US 12,460,501 B2
(45) Date of Patent: Nov. 4, 2025

(54) THROUGH-TUBING PLUG

(71) Applicant: SAUDI ARABIAN OIL COMPANY, Dhahran (SA)

(72) Inventors: Ali Al Shaikh, Dhahran (SA); Abdullrohman K. Alarfaj, Dhahran (SA); Miguel Augusto Avila Romero, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/478,504

(22) Filed: Sep. 29, 2023

(65) Prior Publication Data

US 2025/0109648 A1 Apr. 3, 2025

(51) Int. Cl.

| | |
|---|---|
| ***E21B 33/12*** | (2006.01) |
| ***E21B 31/16*** | (2006.01) |
| ***E21B 34/10*** | (2006.01) |
| ***E21B 34/14*** | (2006.01) |

(52) U.S. Cl.

CPC ..... *E21B 33/12* (2013.01); *E21B 31/16* (2013.01); *E21B 34/103* (2013.01); *E21B 34/14* (2013.01)

(58) Field of Classification Search

CPC ..... E21B 33/12; E21B 33/134; E21B 33/16; E21B 34/103; E21B 34/14; E21B 2200/06

See application file for complete search history.

(56) References Cited

U.S. PATENT DOCUMENTS

| | | | | |
|---|---|---|---|---|
| 6,595,282 | B2 * | 7/2003 | Smith, Jr. | E21B 33/16 166/153 |
| 10,648,272 | B2 * | 5/2020 | Budde | E21B 23/02 |
| 11,624,260 | B2 * | 4/2023 | Nanney | E21B 33/12 166/311 |
| 2019/0368302 | A1 * | 12/2019 | Howlett | E21B 33/068 |
| 2022/0268151 | A1 * | 8/2022 | Toniolo | E21B 23/03 |
| 2023/0084710 | A1 * | 3/2023 | Lende | E21B 27/02 166/285 |
| 2023/0167263 | A1 * | 6/2023 | Shukla | C08K 3/346 523/218 |
| 2024/0200423 | A1 * | 6/2024 | Saraya | E21B 43/261 |

OTHER PUBLICATIONS

Mendez et al., "Field Use of Thru-Tubing Electric Wireline Set Bridge Plug System," Paper No. OTC-6459-MS, Offshore Technology Conference, May 1990.

* cited by examiner

*Primary Examiner* — Nicole Coy
*Assistant Examiner* — Nicholas D Wlodarski
(74) *Attorney, Agent, or Firm* — Vorys, Sater, Seymour and Pease LLP

(57) ABSTRACT

A through-tubing plug includes an outer mandrel defining a first uphole port and a first downhole port, an inner mandrel received within the outer mandrel and defining a second uphole port and a second downhole port, a plug core provided on the outer mandrel and providing a landing profile sealingly engageable with a landing receptor provided within completion tubing extended into a wellbore, and one or more sets of wipers made of a foam material and secured to the outer mandrel distal to the plug core. The inner mandrel is movable between an unactuated state, where the first and second uphole ports are misaligned and the first and second downhole ports are misaligned, and an actuated state, where the first and second uphole ports are aligned and the first and second downhole ports are aligned to thereby allow fluid flow through the through-tubing plug.

20 Claims, 5 Drawing Sheets

THROUGH-TUBING PLUG

FIELD OF THE DISCLOSURE

The present disclosure relates generally to downhole operations in the oil and gas industry and, more particularly, to through-tubing plugs used to plug wellbores.

BACKGROUND OF THE DISCLOSURE

Oil wells are commissioned to extract, among other resources, hydrocarbons (e.g., oils and gas) from hydrocarbon-bearing reservoirs contained in rock formations below the ground. Wellbores are typically drilled and completed for extracting resources from the reservoirs, and the resulting wellbore may be lined with a string of casing that is cemented in place.

Over the lifetime of a well, workover operations or well interventions may be necessary to maintain and/or enhance well productivity and economic viability. When workover operations are needed, temporary or permanent plugs may deployed within the wellbore to control the flow of fluids, such as by isolating or sealing off one or more sections of the wellbore. While cement plugs have been conventionally used for these operations, cement plugs today are often used alongside tubing plugs, such as mechanical plugs, bridge plugs and inflatable plugs, to seal off well sections. However, such solutions are known to have several disadvantages.

Particularly, existing solutions may not be sufficiently flexible for drifting through completion tubing, such as production tubing, during displacement and landing, and thus are susceptible to being stuck in the completion tubing. Existing solutions also cannot be secured to landing nipples or receptors provided in completion tubing to adequately control fluid losses. Moreover, such plugs must be redesigned and modified for use with slickline, wireline and coiled tubing, and for being secured to the landing receptors. Existing solutions also cannot be adapted for use in plug and abandonment operations.

Workover operations also consume significant amounts of fluids. Lack of control of fluid losses and hydrostatic reduction also pose significant risks of damaging the well, and may add to overall cost of production. While solutions have been proposed to manage the operations under losses and provide a safe well control environment during de-completion and completion phases, there is a need for a solution to minimize losses and risks, and optimize the operation by reducing time and costs associated with such operations. In sum, there is a need for a through-tubing plug that can pass through the completion tubing with minimal risk of jamming, and can locate the landing receptor in the completion tubing to prevent fluid losses, while helping to facilitate plug and abandonment operations.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a through-tubing plug is disclosed and includes an outer mandrel defining a first uphole port and a first downhole port, an inner mandrel received within the outer mandrel and defining a second uphole port and a second downhole port, a plug core provided on the outer mandrel and providing a landing profile sealingly engageable with a landing receptor provided within completion tubing extended into a wellbore, and one or more sets of wipers made of a foam material and secured to the outer mandrel distal to the plug core; wherein the inner mandrel is movable between an unactuated state, where the first and second uphole ports are misaligned and the first and second downhole ports are misaligned, and an actuated state, where the first and second uphole ports are aligned and the first and second downhole ports are aligned to thereby allow fluid flow through the through-tubing plug.

According to another embodiment consistent with the present disclosure, a method of plugging a wellbore is disclosed and includes conveying a through-tubing plug into completion tubing extended within the wellbore, the through-tubing plug including an outer mandrel defining a first uphole port and a first downhole port, an inner mandrel received within the outer mandrel and defining a second uphole port and a second downhole port, and a plug core provided on the outer mandrel and providing a landing profile. The method may further include engaging an internal surface of the completion tubing with one or more sets of wipers secured to the outer mandrel and made of a foam material as the through-tubing plug traverses the completion tubing, sealingly engaging the landing profile against a landing receptor provided within completion tubing and thereby plugging the wellbore at the landing profile, moving the inner mandrel from an unactuated state, where the first and second uphole ports are misaligned and the first and second downhole ports are misaligned, to an actuated state, where the first and second uphole ports are aligned and the first and second downhole ports are aligned to thereby allow fluid flow through the through-tubing plug, and removing the through-tubing plug from the landing receptor with the inner mandrel in the actuated state.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1A:
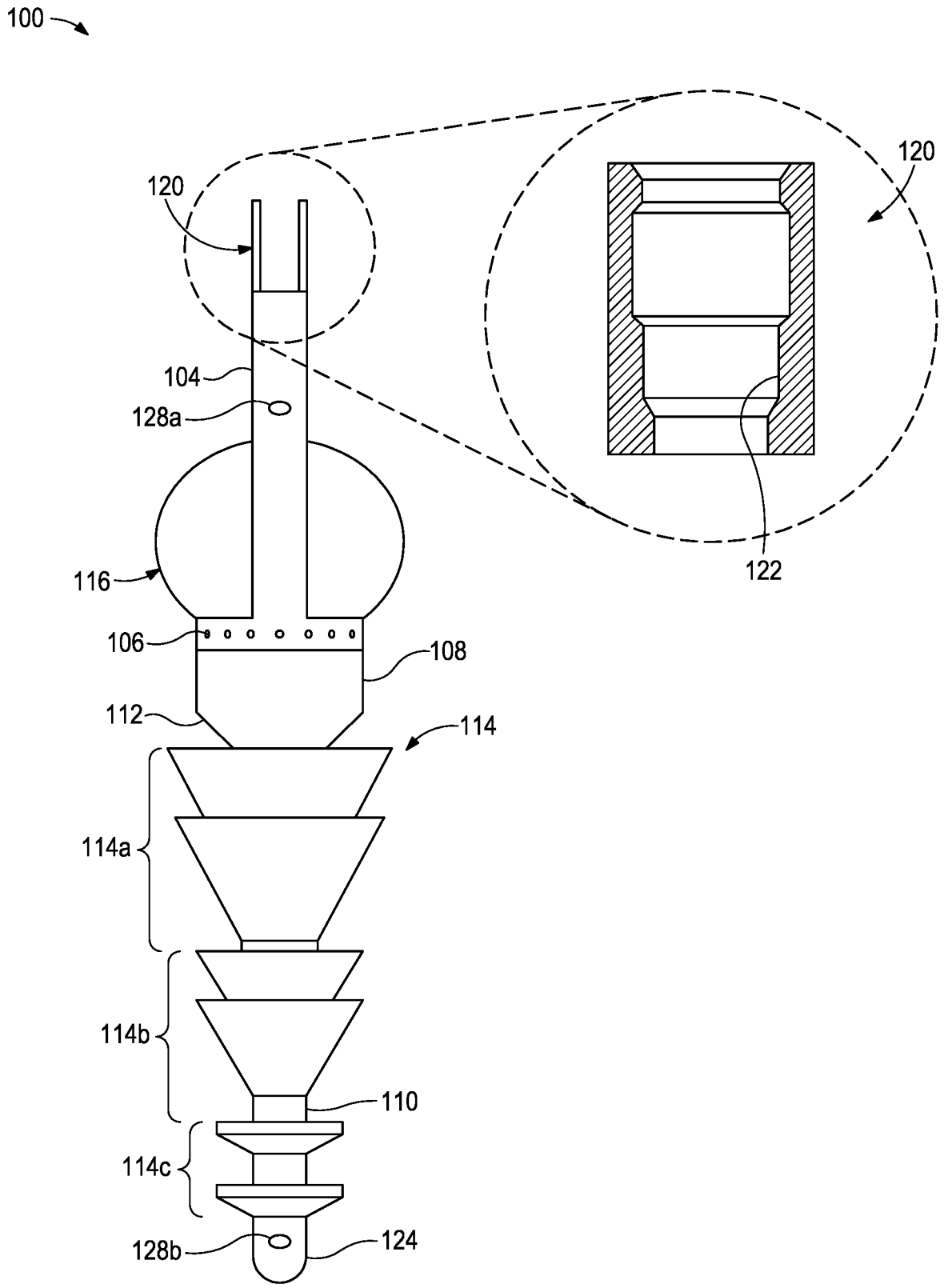
FIG. 1A is a schematic diagram of an example through-tubing plug, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to downhole intervention operations in the oil and gas industry and, more particularly, to through-tubing plugs used to plug wellbores. The present disclosure describes various embodiments and applications for through-tubing plugs that may be deployed to temporarily or permanently plug a wellbore. In some cases, the wellbore may be plugged to isolate desired sections of completion tubing to facilitate workover operations, such as de-completion operations. During such workover operations, and after killing the well, fluid losses or good injectivity are normally experienced. The through-tubing plugs described herein can be conveyed downhole to be landed on a landing receptacle to either control fluid losses or hold a full column of control fluid while the de-completion operation is undertaken. The through-tubing plugs also have other potential applications, such as isolating a subterranean reservoir and/or assisting in plug and abandonment (P&A) operations by pumping a cement slurry ahead of the plug.

Figure 1B:
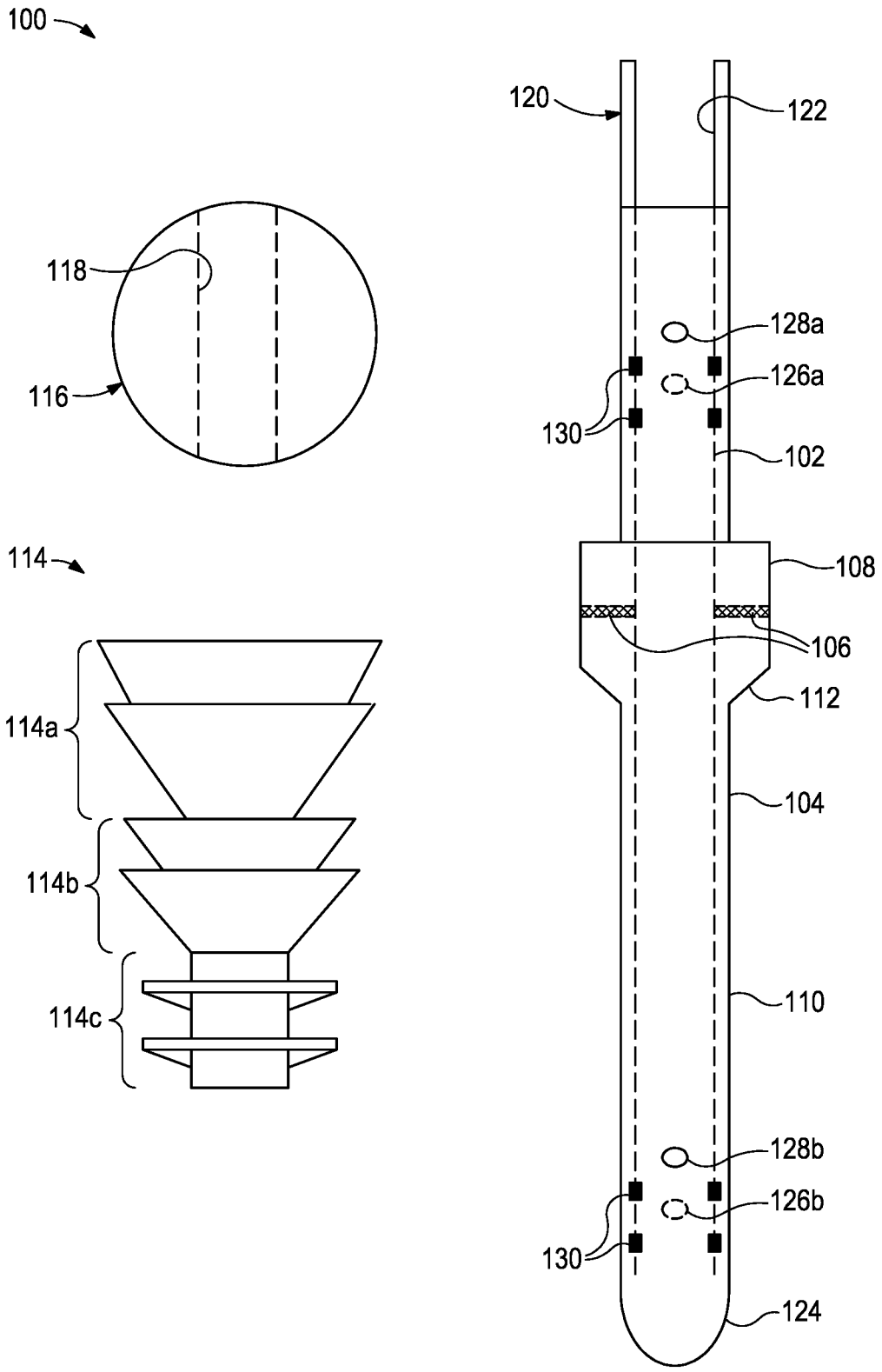
FIG. 1B is a disassembled view of the through-tubing plug.

FIGS. 1A and 1B are schematic assembled and partially exploded side views, respectively, of an example through-tubing plug 100 that may incorporate the principles of the present disclosure. As illustrated, the through-tubing plug 100 (hereafter "the plug 100") may include an inner mandrel 102 and an outer mandrel 104, where the inner mandrel 102 is received within the outer mandrel 104. In some embodiments, the inner and outer mandrels 102, 104 may be held together using one or more shearable devices 106. The shearable devices 106 may include, but are not limited to, shear pins, shear screws, a shear ring, any combination thereof, or any other type of device capable of shearing (breaking) upon assuming a predetermined force or shear load.

The outer mandrel 104 may include or define a plug core 108 and an elongated portion 110 extends distally from the plug core 108. The plug core 108 provides a landing profile 112 on its bottom or "downhole" end. As described in more detail below, the plug 100 may be conveyed (e.g., pumped) downhole until the plug core 108 locates a landing receptor, and the landing profile 112 may be configured to generate a sealed interface against the landing receptor and thereby provide a "plug" within downhole completion tubing. The plug core 108 may have a diameter that is slightly smaller than the inner diameter of the completion tubing. In at least one embodiment, the plug core 108 may have a threaded portion that engages with a corresponding threaded portion of the landing receptor to removably attach the plug 100 to the landing receptor.

A set of wipers 114 may be secured to or form part of the elongated portion 110. When the plug 100 is conveyed into tubing extended within a wellbore, such as completion tubing, the wipers 114 may be configured to slidably engage and "sweep" the internal surface of the completion tubing, thereby allowing the plug 100 to be pumped through the completion tubing under hydraulic pressure. The wipers 114 may be made of resilient or flexible materials that allow the wipers 114 to conform to the shape and contour of the internal surfaces of the completion tubing, which minimizes the risk of jamming or becoming stuck while being pumped downhole. In some embodiments, the wipers 114 may be made of a foam material such as, but not limited to, urethane foam, polyurethane foam, an equivalent flexible foam material, or any combination thereof. This is in contrast to conventional downhole wipers, which are typically not made of foam, but instead are made of rubber (e.g., nitrile rubber), phenolic resins, nylon, or the like. The flexibility of the wipers 114 may be suitably adjusted by varying the density of the foam and the size, shape and composition thereof.

In some embodiments, plug 100 may be deployed through completion tubing and the wipers 114 may engage, sweep, and clean the inner wall of the completion tubing as the plug 100 descends downhole. In other embodiments, or in addition thereto, the plug 100 may be deployed into a wellbore without completion tubing. In such embodiments, the wipers 114 may engage, sweep, and clean the inner walls of the wellbore, thereby removing residue that may be present thereon.

In an example, the wipers 114 may be able to flex and conform to projections, shoulders, or other obstacles commonly found on the internal surface of completion tubing. Moreover, when the plug 100 is pumped through a bend in the completion tubing, the wipers 114 may resiliently abut against the internal surface such that the wipers 114 flex according to the curvature of the bend. The wipers 114 may then return to their natural (expanded) shape when the plug 100 advances past the bend, thereby allowing the plug 100 to pass through with minimal risk of becoming stuck or lodged in the completion tubing.

In the illustrated embodiment, the wipers 114 may include a plurality of discrete sets of wipers, shown as a first set of wipers 114*a*, a second set of wipers 114*b*, and a third set of wipers 114*c*. While three sets of wipers 114*a-c* are shown forming part of the plug 100, more or less than three sets may be included, without departing from the scope of the disclosure. The sets of wipers 114*a-c* may be arranged on the elongated portion 110 distal to the plug core 108 for slidingly engaging the internal surface of the tubing into which the plug 100 is conveyed. In some embodiments, the diameter of the first set of wipers 114*a* may be larger than the inner diameter of the tubing, and the diameter of the second set of wipers 114*b* be slightly larger than the inner diameter of the tubing; e.g., the diameter of the first set of wipers 114*a*>the diameter of the second set of wipers 114*b*. In contrast, the diameter of the third set of wipers 114*c* may be approximately the same as or equal to the inner diameter of the tubing into which the plug 100 is conveyed. Accordingly, the sets of wipers 114*a-c* may be arranged in an ascending/descending order of corresponding diameters. In other embodiments, however, it is contemplated herein to have two or more of the sets of wipers 114*a-c* exhibiting the same diameter, without departing from the scope of the disclosure.

The third set of wipers 114*c* may have a substantially annular profile and may be perpendicularly affixed to the elongated portion 110. In contrast, the first and second sets of wipers 114*a,b* may exhibit substantially conical profiles, and may be angled to incline towards the plug core 108. Each wiper in the first and second sets of wipers 114*a,b* may be concentrically arranged such that at least a portion of the surface areas thereof axially overlap with each other. The contours, dimensions and geometric profile of the wipers 114 may be suitably adapted to allow the plug 100 to be pumped through tubing with minimal risk of jamming at unintended segments of the tubing.

In some embodiments, the plug 100 may further include one or more spherical wipers 116 (one shown) operatively coupled to the outer mandrel 104 uphole from the plug core 108. As illustrated, the spherical wiper 116 may have a substantially spherical profile and may define an inner channel 118 (FIG. 1B) sized to receive the outer mandrel 104 so that the spherical wiper 116 can be mounted to the outer mandrel 104. The spherical wiper 116 may exhibit an outer diameter larger than the inner diameter, through which the plug 100 is conveyed. The spherical wiper 116 may be made of any of the flexible or pliable materials mentioned above for the wipers 114, and may be configured to wipe and clean the internal surface of the completion tubing as the plug 100 is pumped therethrough. Accordingly, the wipers 114 and the spherical wiper 116 may cooperatively aid in cleaning the interior of the completion tubing and wellbore. In other embodiments, however, the spherical wiper 116 may be made of a material such as, but not limited to, rubber (e.g., nitrile rubber), a phenolic resin, nylon, or the like.

In some embodiments, the plug 100 may provide or otherwise define a fishing neck 120 at the uphole end of the plug 100. The fishing neck 120 may form an integral extension of the inner mandrel 102 and, as best seen in the inset graphic of FIG. 1A, the fishing neck 120 may define an inner profile 122 configured to be engageable or otherwise matable with a retrieving (fishing) tool (not shown). In at least one embodiment, the inner profile 122 may comprise a GS-type universal profile commonly used in the oil and gas industry with downhole retrieving tools. In some embodiments, the inner profile 122 may be used to help convey the plug 100 into the wellbore. In such embodiments, for example, a retrieving tool secured to a downhole conveyance may be operatively coupled to the plug 100 at the inner profile 122, and the combination of the downhole conveyance and the retrieving tool may cooperatively control the downhole descent of the plug 100. In other embodiments, however, the plug 100 may be pumped downhole without the need of a downhole conveyance or retrieving tool, as described in more detail below.

The distal end of the plug 100 may provide or otherwise define a nose 124 configured to help guide the plug 100 as it is conveyed into a wellbore. In some embodiments, as illustrated, the nose 124 may have a substantially circular or rounded contour, which may help the plug 100 traverse obstacles, shoulders, debris, or the like within the wellbore or the tubular. In some embodiments, the diameter of the nose 124 may be less than the outer diameter of a downhole conveyance (e.g., slickline) used to convey the plug 100 into the wellbore.

Referring to FIG. 1B, the plug 100 may be configured to allow fluid communication through the plug, such as from a first or "uphole" end to a second or "downhole" end of the plug 100, to enable the plug 100 to be retrieved from the wellbore. To facilitate fluid communication through the plug 100, the inner and outer mandrels 102, 104 may each provide or otherwise define flow ports that, when aligned, may allow fluid flow through the plug 100. More specifically, the inner mandrel 102 provides one or more first or "uphole" ports 126*a* and one or more first or "downhole" ports 126*b*, and the outer mandrel 104 may provide one or more second or "uphole" ports 128*a* and one or more second or "downhole" ports 128*b*. The uphole ports 126*a*, 128*a* are provided above the plug core 108 and below the fishing neck 120, while and the downhole ports 126*b*, 128*b* are provided below the plug core 108 and uphole from the nose 124.

When the uphole ports 126*a*, 128*a* and the downhole ports 126*b*, 128*b* are misaligned, respectively, flow through the plug 100 in either direction is substantially prevented. The inner mandrel 102, however, may be able to be shifted upwards (uphole) to align the uphole ports 126*a*, 128*a* and the downhole ports 126*b*, 128*b*, respectively, to enable fluid flow through the plug 100. In some embodiments, one or more seals 130 may be arranged at an interface between the inner and outer mandrels 102, 104. In the illustrated embodiment, for example, the seals 130 may be included to generate sealed interfaces above (uphole) and below (downhole) the first uphole ports 126*a* and above (uphole) and below (downhole) the first downhole ports 126*b*. In other embodiments, the seals 130 may alternatively be arranged at interfaces above (uphole) and below (downhole) the second uphole ports 128*a* and above (uphole) and below (downhole) the second downhole ports 128, or any combination thereof. The seals 130 may comprise, for example, O rings or the like, but could alternatively comprise any type of seal capable of generating a sealed interface between the inner and outer mandrels 102, 104, without departing from the scope of the disclosure.

Figure 2A:
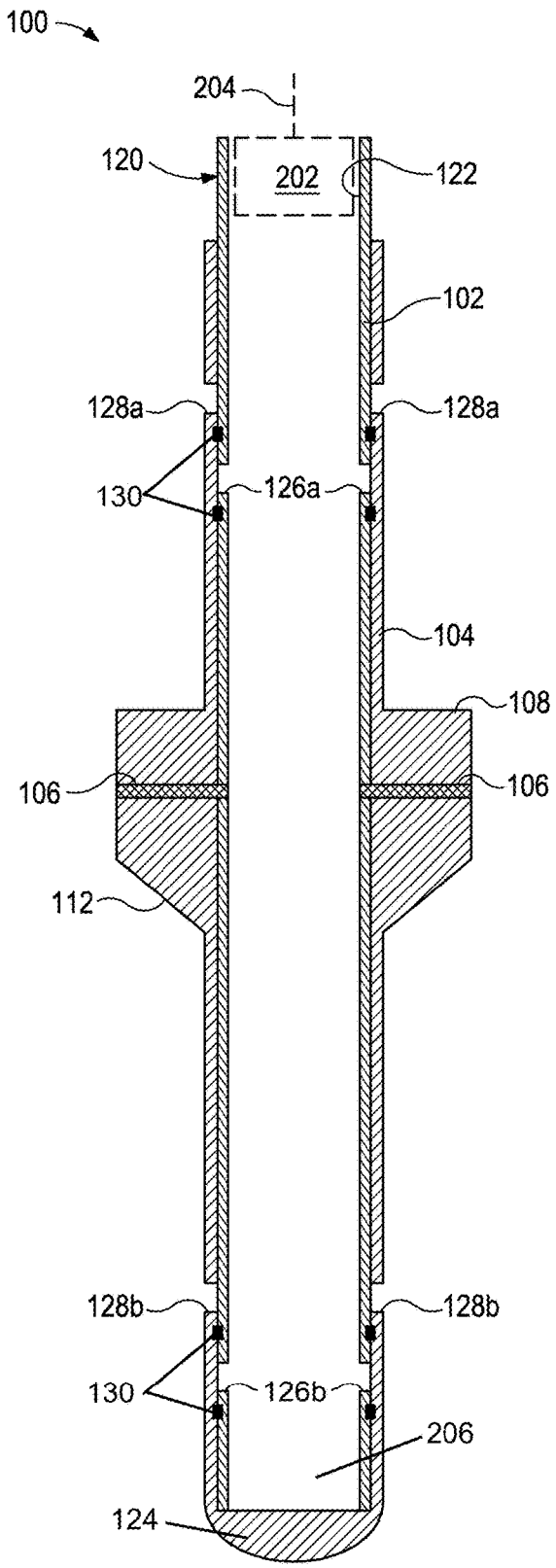
FIGS. 2A and 2B are cross-sectional side views of a portion of the plug of FIGS. 1A-1B depicting example actuation, according to one or more embodiments of the present disclosure.
Figure 2B:
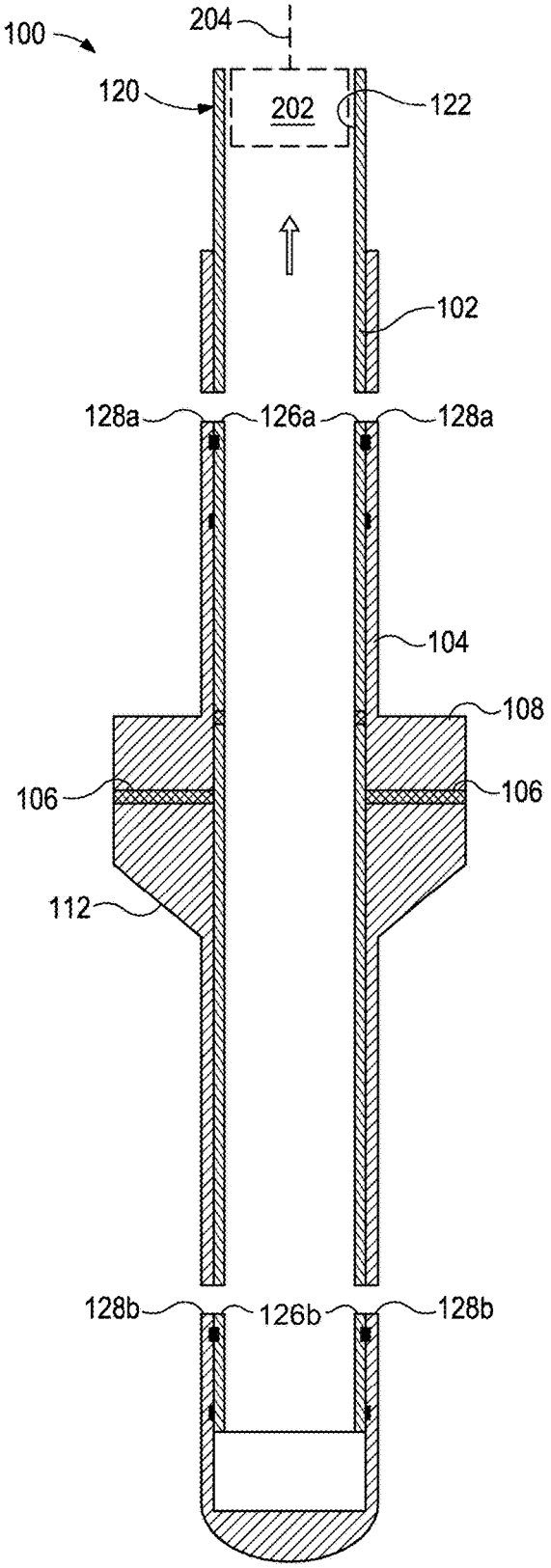

Referring now to FIGS. 2A and 2B, with continued reference to FIGS. 1A-1B, depicted are cross-sectional side views of a portion of the plug 100 demonstrating example operation of the plug 100, according to one or more embodiments of the present disclosure. For ease of viewing, various component parts of the plug 100 are omitted in FIG. 2A-2B, such as the wipers 114 (FIGS. 1A-1B) and the spherical wiper 116 (FIGS. 1A-1B), but such components would otherwise be included.

FIG. 2A depicts the plug 100 in a first or "unactuated" state, and FIG. 2B depicts the plug 100 in a second or "actuated" state. FIG. 2A shows the inner mandrel 102 received within a blind bore 206 of the outer mandrel 104, and the nose 124 is shown as a closed nose. In the unactuated state, the uphole ports 126*a*, 128*a* and the downhole ports 126*b*, 128*b* are misaligned, and the inner and outer mandrels 102, 104 are axially secured together using the shearable devices 106. Moreover, the seals 130 are included to generate corresponding sealed interfaces. Consequently, fluid flow through the plug 100, in either direction, is substantially prevented.

The plug 100 can be transitioned to the actuated state by shearing or otherwise breaking the shearable devices 106, and then subsequently moving (shifting) the inner mandrel 102 in the uphole direction (e.g., upwards in FIGS. 2A-2B) relative to the outer mandrel 104. In some embodiments, to shear the shearable devices 106, a pressure differential may be created between the uphole and downhole ends of the plug 100. This can be accomplished by increasing the pressure uphole from the plug 100, which urges the inner mandrel 102 upward and simultaneously shears the shearable devices 106.

In other embodiments, however, the shearable devices 106 may be sheared by conveying a GS retrieving tool 202 (shown in dashed lines), alternately referred to as a shifting, fishing, or jarring tool, into the wellbore to locate and mate with the inner profile 122 defined on the fishing neck 120. As illustrated, the fishing neck 120 forms an integral extension of the inner mandrel 102. The retrieving tool 202 may be conveyed downhole on a downhole conveyance 204, which may comprise, for example, but is not limited to, slickline, wireline, coiled tubing, drill pipe, or any combination thereof. Once the retrieving tool 202 successfully mates with the inner profile 122, tension in the uphole direction may be applied on the inner mandrel 102 via the interconnection between the retrieving tool 202 and the fishing neck 120 until the shearable devices 106 are successfully sheared. With the shearable devices 106 sheared, the inner mandrel 102 is free to transition the plug 100 to the actuated state.

FIG. 2B depicts the plug 100 in the actuated state. Once the shearable devices 106 are sheared, the inner mandrel 102 will be freed from the outer mandrel 104, which allows the inner mandrel 102 to move relative to the outer mandrel 104. As the inner mandrel 102 moves uphole relative to the outer mandrel 104 the uphole ports 126*a*, 128*a* and the downhole ports 126*b*, 128*b* become aligned, respectively. In some embodiments, the plug 100 may include shoulders or other types of abutments (not shown) that prevent the inner mandrel 102 from being entirely removed from the outer mandrel 104, but instead stop axial movement of the inner mandrel 102 at a point where the uphole ports 126*a*, 128*a* and the downhole ports 126*b*, 128*b* are aligned, respectively.

With the uphole ports 126*a*, 128*a* and the downhole ports 126*b*, 128*b* aligned, respectively, fluid communication between the uphole and downhole ends of the plug 100 may be achieved to equalize pressure therebetween. This may prove advantageous in relieving fluid pressure from the uphole end and allowing the plug 100 to be retrieved (removed) from the wellbore, if desired. The retrieving tool 202 (shown in dashed lines) may then be used to remove the plug 100. More specifically, uphole movement of the retrieving tool 202 via the conveyance 204 will draw the plug 100 back uphole to be retrieved at the well surface. In other embodiments, however, the inner mandrel 102 may be fished out of the completion tubing without the outer mandrel 104, thereby permanently plugging the wellbore.

Figure 3C:
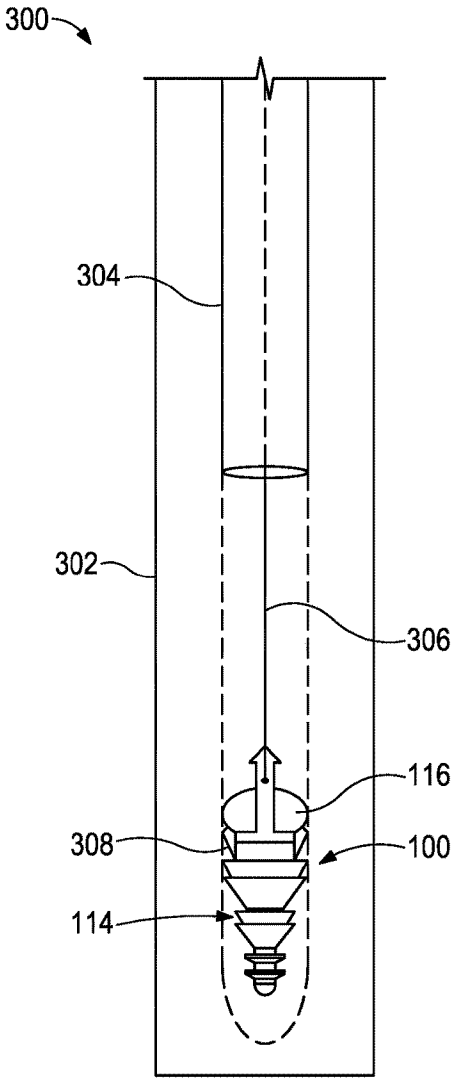
FIGS. 3A to 3C are schematic side views of an example wellbore system showing progressive actuation and operation of the plug of FIGS. 1A-1B, according to one or more embodiments.
Figure 3B:
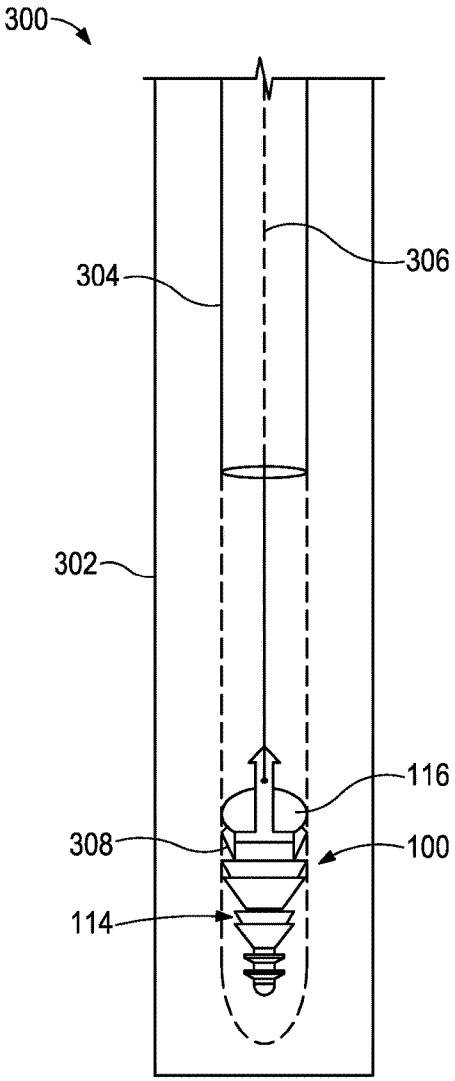
Figure 3A:
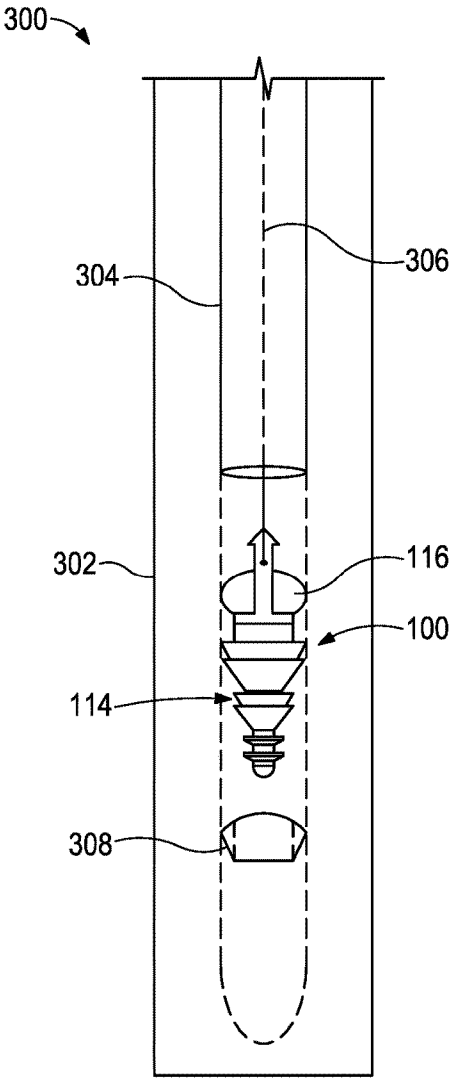

FIGS. 3A to 3C are schematic side views of an example wellbore system 300 showing progressive actuation and operation of the plug 100, according to one or more embodiments. As illustrated, the wellbore system 300 includes a wellbore 302, and a string of completion tubing 304 is extended into the wellbore 302. The completion tubing 304 may comprise any of a variety of types of downhole tubulars or strings of tubing commonly used in the oil and gas industry. For example, the completion tubing 304 can include, but is not limited to, production tubing, casing, liner, well tubing, or any combination thereof. In embodiments where the completion tubing 304 comprises production tubing, the completion tubing 304 provides a means of conveying reservoir fluids (e.g., hydrocarbons) to the well surface, while simultaneously providing a conduit to pump other fluids downhole to undertake various downhole operations. The wellbore 302 may include a well head disposed at or near the surface, via which the extracted fluid resources may be collected and stored.

The plug 100 may be attached to and conveyed downhole within the interior of the completion tubing 304 on the downhole conveyance 204, as generally described above. The downhole conveyance 204 may be attached to the plug 100 at the fishing neck 120 (FIGS. 1A-1B), as described above, and may be subsequently used to remove the plug 100 from the completion tubing 304, if desired. As the plug 100 traverses the completion tubing 304, the wipers 114 and the spherical wiper 116 may be operable to engage, sweep, and clean the inner wall of the completion tubing 304, thereby removing any residue or debris that may be present thereon.

In some embodiments, the completion tubing 304 may include one or more landing receptors 308 (one shown in FIGS. 3A-3C) provided or defined within the interior of the completion tubing 304, or otherwise forming part of the string of the completion tubing 304. The landing receptor 308 may comprise, for example, a profile or radial shoulder run with the completion tubing 104 tubing, potentially being threaded between pup joints to facilitate their handling. In other embodiments, or in addition thereto, the landing receptor 308 may comprise a profile (e.g., X, XN, R, etc. built into completion accessories) a no-go nipple, a selective-landing nipple, a ported safety valve, or any combination thereof. The landing receptor 308 provides a radial shoulder or the like configured to receive the plug core 108 (FIGS. 1A-1B) to generate a sealed interface upon receiving the plug 100. Accordingly, the plug core 108 exhibits an outer diameter larger than the inner profile of the landing receptor 308 to enable the plug core 108 to locate and sealingly engage the landing receptor 308.

As attached to the downhole conveyance 204, the plug 100 may conveyed downhole until the plug core 108 (FIGS. 1A-1B) locates and lands on the landing receptor 308, and the landing profile 112 (FIGS. 1A-1B) of the plug core 108 creates a sealed interface with the landing receptor 308. In some embodiments, the plug 100 may be lowered into the completion tubing 304 under the force of gravity. In other embodiments, however, the plug 100 may be pumped into the completion tubing 304 under fluid pressure until locating the landing receptor 308. In such embodiments, the plug 100 may operate in a bullheading capacity to displace one or more fluids disposed in front of (downhole from) the plug 100 as it advances downhole. Example fluids that could be displaced by the plug 100 include, but are not limited to, cement, a spacer fluid, mud, water, brines, acid, solvents, any fluid used in the oil and gas industry, or any combination thereof.

Referring to FIG. 3B, once the plug 100 locates the landing receptor 308, the wipers 114 may bypass (pass through) the landing receptor 308. More specifically, since the wipers 114 are made of flexible and pliable materials, the wipers are able to elastically deform to allow the downhole portions of the plug 100 to extend through the landing receptor 308 until the plug core 108 is able to engage and seal against the landing receptor 308. Once sealingly engaged against the landing receptor 308, the plug 100 is held against the landing receptor 308 with elevated fluid pressures uphole from the plug 100. The elevated fluid pressure could result from fluid losses into the formation below the plug 100, or by using a higher density displacement fluid to convey the plug 100 downhole. The plug 100 may be able to control fluid losses within the wellbore 302 and may hold a column of control fluids (uphole) during workover operations. In some embodiments, two or more plugs 100 may be pumped into the completion tubing 304 to isolate desired sections of the wellbore 302. Isolating sections of the wellbore 302 may allow for selective performance of workover operations therein.

With the plug 100 sealingly engaged against the landing receptor 308, the plug 100 may then be selectively actuated to transition the inner mandrel 102 between the unactuated state, as shown in FIG. 2A, and the actuated state, as shown in FIG. 2B. Transitioning the inner mandrel 102 to the actuated state requires that the shearable devices 106 (FIGS. 1A-1B and 2A-2B) are first sheared, following which the inner mandrel 102 (FIGS. 1B and 2A-2B) may be shifted uphole relative to the outer mandrel 104 (FIGS. 1A-1B and 2A-2B) to align the uphole ports 126*a*, 128*a* (FIGS. 1B and 2A-2B) and the downhole ports 126*b*, 128*b* (FIGS. 1A-1B and 2A-2B), respectively. As discussed above, shearing the shearable devices 106 may be accomplished either by pulling uphole on the inner mandrel 102 with the retrieving tool 202 (FIGS. 2A-2B), or by generating a pressure differential that causes the inner mandrel 102 to move relative to the outer mandrel 104. Once the uphole ports 126*a*, 128*a* are aligned and the downhole ports 126*b*, 128*b* are aligned, fluids may then be able to traverse (flow through) the interior of the plug 100 in the either the uphole or downhole direction. However, in some instances, the fluid pressure above the plug 100 may be greater than below the plug 100 due to losses in the wellbore or the use of a higher fluid density displacement fluid used to convey the plug 100 downhole.

Referring to FIG. 3C, in some embodiments, the plug 100 may be temporarily deployed in the completion tubing 304 and retrieved once the workover operations are complete to allow fluids (e.g., hydrocarbons) to resume flowing to the well surface through the completion tubing 304. In such embodiments, the plug 100 may be retrieved by lowering the retrieving tool 202 (FIGS. 2A-2B) into the wellbore 302 on the downhole conveyance 204 to locate and mate with the fishing neck 120 (FIGS. 1A-1B), as generally described above. The plug 100 (e.g., the inner mandrel 102) may then be transitioned to the actuated state, where the uphole ports 126*a*, 128*a* (FIGS. 1A-1B, 2A-2B) are aligned and the downhole ports 126*b*, 128*b* (FIGS. 1A-1B, 2A-2B) are aligned, thus achieving fluid communication between the uphole and downhole ends of the plug 100 and equalizing the pressure therebetween. This allows the plug 100 to be retrieved by flowing fluids through the plug 100 during its ascent. The plug 100 may be pulled back to the well surface by winding or spooling the downhole conveyance 204 at the well surface.

In some embodiments, when the plug 100 is transitioned to the actuated state, an internal release or ring may be actuated to allow the wipers 114 below the plug core 108 (FIGS. 2A-2B) to release from the plug 100. As a result, when the plug 100 is pulled uphole, the wipers 114 may disengage from (fall or slide off) the plug 100 as they engage the underside of the landing receptor 308. Once disengaged from the plug 100, the wipers 114 may fall into the wellbore 302 and the plug 100 will be able to ascend without being hindered by the wipers 114. In other embodiments, however, the flexible and pliable material of the wipers 114 will allow the wipers 114 to deform and otherwise fold backwards as forced against the underside of the landing receptor 308. This will allow the wipers 114 to be pulled uphole and through the landing receptor 308 as the plug 100 is drawn in the uphole direction.

In other embodiments, it may be desired to plug and abandon (P&A) the wellbore 302. In such embodiments, the plug 100 may be permanently retained within the completion tubing 304 and used to help convey cement necessary to seal the wellbore 302. It will be appreciated by those skilled in the art that the plug 100 may be suitably adapted for other applications requiring temporary or permanent stoppage of hydrocarbon production.

In some implementations, the plug 100 may be used as a well barrier for nipple-down production trees and nipple-up blowout preventers. By using the plug 100 to selectively seal and isolate one or more segments of the completion tubing 304, the plug 100 may also reduce the quantity of fluids for performing workover operations when compared to conventional solutions. Further, the fluids used during workover operations may be circulated back uphole and reused for further operations. Additionally, once the plug 100 is securely landed on the landing receptor 308, the reservoir or segments of the completion tubing 304 may be isolated from other sections of the completion tubing 304, thereby allowing workover operations to be performed safely therein. The plug 100 may optionally allow operators of oil wells to plug and abandon the well. The plug 100 may also be used for plug and abandonment of the well with completion trees, and packers disposed therein.

Figure 4:
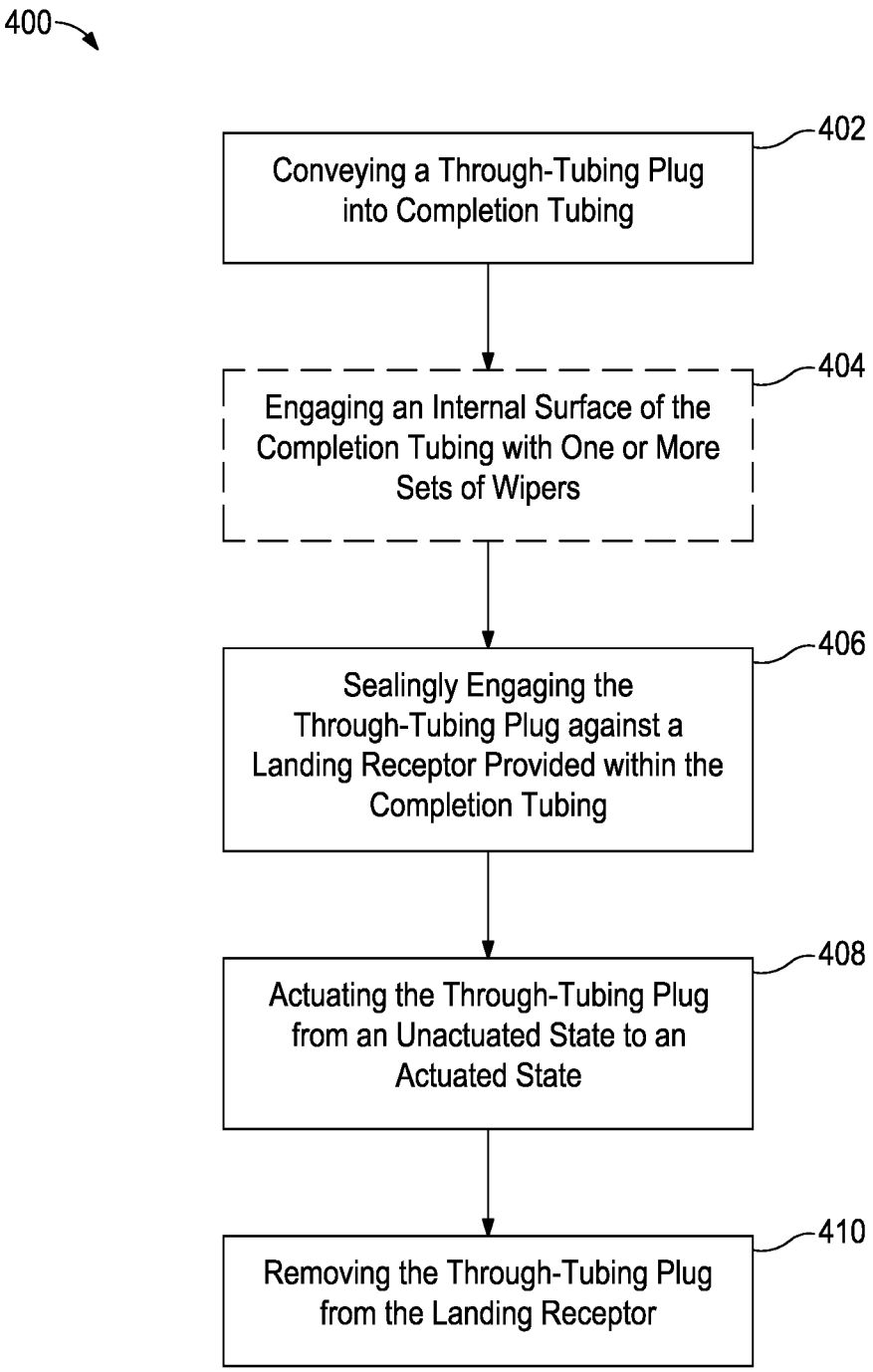
FIG. 4 is a flowchart of an example method for using a through-tubing plug to plug a wellbore.

FIG. 4 is a schematic flowchart of an example method 400 for using a through-tubing plug to plug a wellbore, according to one or more embodiments. The method 400 may be best understood with reference to the discussion provided above. As illustrated, the method 400 may include, conveying the through-tubing plug into completion tubing extended within the wellbore, as at 402. As discussed above, the through-tubing plug may include an outer mandrel defining a first uphole port and a first downhole port, and an inner mandrel received within the outer mandrel and defining a second uphole port and a second downhole port. A plug core may also be provided on the outer mandrel and may provide or define a landing profile.

In some embodiments, the method may optionally include engaging an internal surface of the completion tubing with one or more sets of wipers as the through-tubing plug traverses the completion tubing, as at 404. As described herein, the wipers may be secured to the outer mandrel and may be made of a foam material. In operation, the wipers may engage, sweep, and clean the inner walls of the completion tubing as the through-tubing plug advances downhole.

The method 400 may further include sealingly engaging the landing profile of the through-tubing plug against a landing receptor provided within the completion tubing and thereby plugging the wellbore at the landing profile, as at 406. The method 400 may then include actuating the through-tubing plug from an unactuated state to an actuated state, and thereby equalizing pressure across the through tubing-plug, as at 408. As described herein, this may be accomplished by moving the inner mandrel from an unactuated state, where the first and second uphole ports are misaligned and the first and second downhole ports are misaligned, to an actuated state, where the first and second uphole ports are aligned and the first and second downhole ports are aligned. With the first and second uphole ports aligned and the first and second downhole ports aligned, the method 400 may further include removing the through-tubing plug from the landing receptor, as at 410.

In some embodiments, the method 400 may include providing a set of kill fluids in front of the through-tubing plug. The set of kill fluids may include a plurality of sets of spacer fluids and a slurry of cement disposed therebetween. The method may include pumping the through-tubing plug to force the set of kill fluids to push a fluid resource out of the production tubing into a reservoir.

In some embodiments, the method 400 may include retrieving the through-tubing plug from the production tubing by a pulling downhole intervention string attached to a fishing neck defined on an inner mandrel of the through-tubing plug, thereby unplugging the wellbore. In such embodiments, for retrieving the through-tubing plug, the method 400 may include jarring the inner mandrel via the downhole intervention string such that a fastening means attaching the inner mandrel with the outer mandrel may be sheared. Once the fastening means is sheared, a set of inner ports associated with the inner mandrel may be aligned with a set of outer ports associated with the outer mandrel to allow fluids to pass therethrough.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

As used herein, "substantially" means largely or considerably, but not necessarily wholly, that is sufficient to work for the intended purpose. The term "substantially" thus allows for minor, insignificant variations from an absolute or perfect state, dimension, measurement, result, or the like as would be expected by a person of ordinary skill in the art, but that do not appreciably affect overall performance.

As used herein, "about" means approximately or nearly and in the context of a numerical value or range set forth means ±10% of the numeric value.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A through-tubing plug, comprising:

an outer mandrel defining a first uphole port and a first downhole port;

an inner mandrel received within the outer mandrel and including:

a first end surface defining a first open end;

a second end surface opposite the first end surface and defining a second open end;

an exterior surface extending between the first and second end surfaces;

an interior surface opposite the exterior surface and extending between the first and second end surfaces, the interior surface defining a bore that extends from the first open end to the second open end;

a second uphole port extending between the interior and exterior surfaces; and a second downhole port extending between the interior and exterior surfaces;

a plug core provided on the outer mandrel and providing a landing profile sealingly engageable with a landing receptor provided within completion tubing extended into a wellbore; and one or more sets of wipers made of a foam material and secured to the outer mandrel distal to the plug core, wherein the inner mandrel is movable between an unactuated state, where the first and second uphole ports are misaligned and the first and second downhole ports are misaligned, and an actuated state, where the first and second uphole ports are aligned and the first and second downhole ports are aligned to thereby allow fluid flow through the through-tubing plug.

2. The through-tubing plug of claim 1, wherein the inner mandrel is secured against axial movement relative to the outer mandrel with one or more shearable devices, and shearing the one or more shearable devices allows the inner mandrel to move to the actuated state.

3. The through-tubing plug of claim 1, wherein the foam material includes a urethane foam and a polyurethane foam.

4. The through-tubing plug of claim 1, wherein the one or more sets of wipers includes:

a first set of wipers having an outer diameter greater than an inner diameter of the completion tubing; and a second set of wipers having an outer diameter approximately equal to the inner diameter of the completion tubing.

5. The through-tubing plug of claim 4, wherein the one or more sets of wipers further includes a third set of wipers axially interposing the first and second sets of wipers, and wherein the third set of wipers has an outer diameter smaller than the first set of wipers, but larger than the second set of wipers.

6. The through-tubing plug of claim 1, further comprising a spherical wiper operatively coupled to the outer mandrel uphole from the plug core, the spherical wiper having an outer diameter greater than an inner diameter of the completion tubing.

7. The through-tubing plug of claim 6, wherein the spherical wiper is formed from a foam material.

8. The through-tubing plug of claim 1, further comprising an inner profile matable with a retrieving tool, wherein the inner profile is defined on the interior surface of the inner mandrel between the first and second open ends.

9. The through-tubing plug of claim 1, wherein the plug core is disposed between the first uphole port and the first downhole port.

10. A method of plugging a wellbore, comprising:

conveying a through-tubing plug into completion tubing extended within the wellbore, the through-tubing plug including:

an outer mandrel defining a first uphole port and a first downhole port;

an inner mandrel received within the outer mandrel and defining a second uphole port and a second downhole port; and a plug core provided on the outer mandrel and providing a landing profile;

engaging an internal surface of the completion tubing with one or more sets of wipers secured to the outer mandrel and made of a foam material as the through-tubing plug traverses the completion tubing;

sealingly engaging the landing profile against a landing receptor provided within completion tubing and thereby plugging the wellbore at the landing profile;

moving the inner mandrel from an unactuated state, where the first and second uphole ports are misaligned and the first and second downhole ports are misaligned, to an actuated state, where the first and second uphole ports are aligned and the first and second downhole ports are aligned to thereby allow fluid flow through the through-tubing plug, wherein moving the inner mandrel from the unactuated state to the actuated state comprises:

conveying a retrieving tool into the wellbore on a downhole conveyance;

mating the retrieving tool with an inner profile defined in a fishing neck provided by the inner mandrel;

providing a shifting force to the inner mandrel from the retrieving tool and thereby shearing one or more shearable devices that secure the inner mandrel against axial movement relative to the outer mandrel; and shifting the inner mandrel uphole relative to the outer mandrel until the first and second uphole ports align and the first and second downhole ports align; and removing the through-tubing plug from the landing receptor with the inner mandrel in the actuated state.

11. The method of claim 10, wherein conveying the through-tubing plug into the completion tubing comprises pumping the through-tubing plug through the completion tubing.

12. The method of claim 11, further comprising displacing one or more fluids downhole from the through-tubing plug as the through-tubing plug advances downhole.

13. The method of claim 10, further comprising engaging an internal surface of the completion tubing with a spherical wiper operatively coupled to the outer mandrel uphole from the plug core, the spherical wiper having an outer diameter greater than an inner diameter of the completion tubing.

14. The method of claim 10, further comprising equalizing pressure across the through-tubing plug with the inner mandrel moved to the actuated state.

15. The method of claim 10, further comprising plugging and abandoning the wellbore with the through-tubing plug engaged against the landing receptor.

16. The method of claim 10, wherein the one or more sets of wipers includes:

a first set of wipers having an outer diameter greater than an inner diameter of the completion tubing;

a second set of wipers having an outer diameter approximately equal to the inner diameter of the completion tubing; and a third set of wipers axially interposing the first and second sets of wipers, the third set of wipers having an outer diameter smaller than the first set of wipers, but larger than the second set of wipers.

17. The method of claim 10, wherein removing the through-tubing plug from the landing receptor with the inner mandrel comprises retrieving the through-tubing plug with the retrieving tool.

18. A through-tubing plug, comprising:

an outer mandrel including a closed nose, a blind bore defined by an interior surface and the closed nose, a first uphole port, and a first downhole port, the first uphole and downhole ports each extending from an exterior surface of the outer mandrel to the interior surface;

a plug core extending radially from the exterior surface of the outer mandrel and interposing the first uphole and downhole ports, the plug core defining a landing profile; and an inner mandrel received within the blind bore of the outer mandrel and defining a second uphole port and a second downhole port, wherein the inner mandrel is movable between an unactuated state, where the first and second uphole ports are misaligned and the first and second downhole ports are misaligned, and an actuated state, where the first and second uphole ports are aligned and the first and second downhole ports are aligned to thereby allow fluid flow through the through-tubing plug.

19. The through-tubing plug of claim 18, wherein the inner mandrel has an interior surface defining a bore that extends from a first open end at an uphole end of the inner mandrel to a second open end at a downhole end of the inner mandrel, and wherein the interior surface of the inner mandrel defines a profile engageable with a retrieving tool.

20. The through-tubing plug of claim 18, further comprising:

one or more sets of foam wipers coupled to the exterior surface of the outer mandrel between the first downhole port and the landing profile of the plug core; and a spherical foam wiper coupled to the exterior surface of the outer mandrel between the first uphole port and the plug core.

* * * * *